US009983514B2

(12) United States Patent
Yamamoto et al.

(10) Patent No.: US 9,983,514 B2
(45) Date of Patent: May 29, 2018

(54) IMAGE FORMING APPARATUS

(71) Applicant: CANON KABUSHIKI KAISHA, Tokyo (JP)

(72) Inventors: Satoru Yamamoto, Noda (JP); Toshiyuki Miyake, Abiko (JP); Katsuya Nakama, Nagareyama (JP); Koji Yumoto, Toride (JP); Riki Fukuhara, Kashiwa (JP); Akihiro Kawakita, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/203,664

(22) Filed: Jul. 6, 2016

(65) Prior Publication Data

US 2017/0052485 A1 Feb. 23, 2017

(30) Foreign Application Priority Data

Aug. 20, 2015 (JP) ..... 2015-163009

(51) Int. Cl.
*G03G 15/16* (2006.01)
*G03G 15/01* (2006.01)
*G03G 15/00* (2006.01)

(52) U.S. Cl.
CPC ..... *G03G 15/1615* (2013.01); *G03G 15/0131* (2013.01); *G03G 15/167* (2013.01); *G03G 15/1665* (2013.01); *G03G 15/5058* (2013.01); *G03G 2215/00742* (2013.01)

(58) Field of Classification Search
CPC ..... G03G 15/0131; G03G 15/1605; G03G 15/161; G03G 15/1615; G03G 15/1665; G03G 15/167; G03G 15/5058; G03G 2215/00742; G03G 2215/1623
See application file for complete search history.

(56) References Cited

U.S. PATENT DOCUMENTS

2012/0207494 A1* 8/2012 Tomura ..... G03G 15/0189 399/40
2015/0362868 A1* 12/2015 Sone ..... G03G 15/1615 399/49
2017/0052487 A1* 2/2017 Hirota ..... G03G 15/0131
2017/0052491 A1* 2/2017 Hirota ..... G03G 15/1615

FOREIGN PATENT DOCUMENTS

JP 2008-281931 11/2008

* cited by examiner

*Primary Examiner* — Carla Therrien
(74) *Attorney, Agent, or Firm* — Fitzpatrick, Cella, Harper & Scinto

(57) ABSTRACT

Provided is an image forming apparatus having high usability and securing both image quality and productivity. The image forming apparatus changes a rotational speed of a secondary transfer member depending on a basis weight of a sheet. The image forming apparatus performs digital sub-scanning scaling of correcting image data and polygon sub-scanning scaling of controlling a scanning speed during image formation so as to cancel out image deformation caused by change in rotational speed of the secondary transfer member. When giving priority to image quality, the image forming apparatus performs processing of the digital sub-scanning scaling and the polygon sub-scanning scaling, and when giving priority to productivity, the image forming apparatus performs only processing of digital sub-scanning scaling.

20 Claims, 8 Drawing Sheets

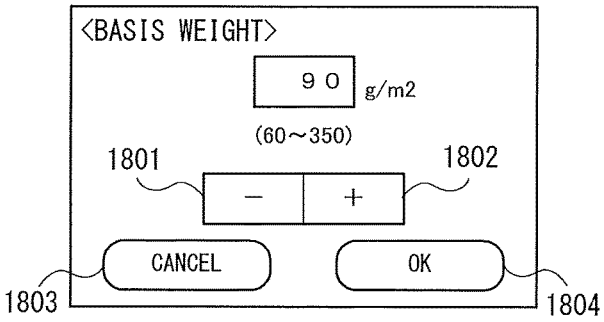
FIG. 4A
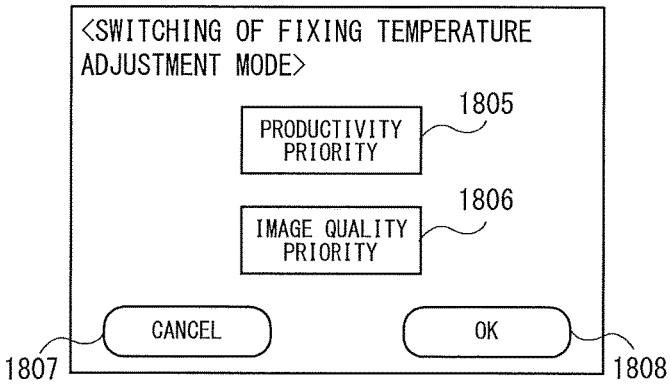
FIG. 4B
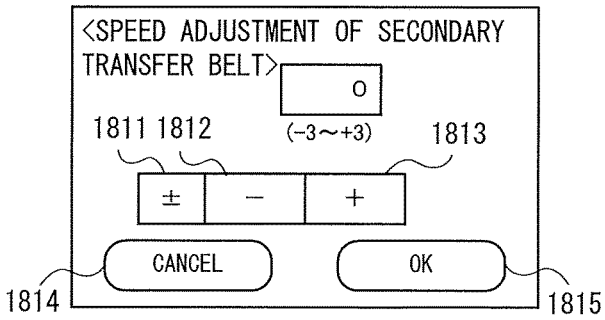
FIG. 4C
| BASIS WEIGHT | IMAGE QUALITY PRIORITY MODE | PRODUCTIVITY PRIORITY MODE |
|---|---|---|
| LESS THAN 150 gsm | 150 °C | 160 °C |
| | 0.60% | 0.60% |
| 150 gsm OR MORE | 170 °C | 160 °C |
| | 1.50% | 0.60% |
FIG. 4D

IMAGE FORMING APPARATUS

BACKGROUND OF THE INVENTION

Field of the Invention

The present invention relates to an image forming apparatus, e.g., a printer, a copying machine, a multifunctional peripheral, or a fax machine.

Description of the Related Art

In recent years, there has been demanded particularly for an image forming apparatus for production printing to form an image on a sheet having an image quality satisfying, e.g., a higher level of color stability and graininess. In an electrophotographic image forming apparatus, images of three subtractive primary colors and black are independently formed on a plurality of photosensitive members, and those images of the respective colors are transferred onto an intermediate transfer member in a superimposed manner, to thereby form a full-color image on the intermediate transfer member. The image formed on the intermediate transfer member is transferred onto a sheet to form an image on the sheet. Image transfer from the photosensitive member onto the intermediate transfer member is referred to as "primary transfer", and image transfer from the intermediate transfer member onto the sheet is referred to as "secondary transfer". The intermediate transfer member is configured to perform the primary transfer and the secondary transfer while being rotated. Such an image forming apparatus employing a secondary transfer system can eliminate disturbance factors to be caused by the property of the sheet at the time of color superimposing as compared to a direct transfer system configured to directly superimpose and transfer images onto a sheet without using the intermediate transfer member. The image forming apparatus employing the secondary transfer system can thus stably form an image on a sheet.

In the image forming apparatus employing the secondary transfer system, the rotational speed (surface speed) of the intermediate transfer member is basically set substantially equal to the conveyance speed of the sheet. Hitherto, in some cases, the image forming apparatus employing this system changes those speeds to cause minute change in image length in the conveyance direction of the sheet. That is, the rotational speed of the intermediate transfer member and the conveyance speed of the sheet are adjusted to slightly change the magnification of the image in the conveyance direction. The image quality can be improved by adjusting the rotational speed of the intermediate transfer member and the conveyance speed of the sheet. For example, in order to reduce graininess in the case of a cardboard sheet or to improve image transfer performance in the case of an embossed sheet, the conveyance speed of the sheet is changed by about 1[%] with respect to the rotational speed of the intermediate transfer member. The difference between the surface speed of the intermediate transfer member and the conveyance speed of the sheet is hereinafter referred to as "speed difference". Further, the conveyance direction of the sheet is a direction orthogonal to a main scanning direction in which laser light is scanned during image formation, and hence the conveyance direction is hereinafter sometimes referred to as a sub-scanning direction.

Secondary transfer is performed at a nip portion, which includes a drive roller around which the intermediate transfer member is looped and a secondary transfer roller, by nipping the intermediate transfer member and the sheet between the drive roller and the secondary transfer roller. In Japanese Patent Application Laid-open No. 2008-281931, there is disclosed an image forming apparatus in which the drive roller (intermediate transfer member) and the secondary transfer roller are respectively driven by independent drive sources, and the rotational speed of the secondary transfer roller is adjusted depending on the thickness of the sheet passing through the nip portion, to thereby suppress color misregistration.

When the speed difference is changed to improve the image quality as described above, the image is deformed, and the magnification in the sub-scanning direction is changed. When priority is given to image quality, the magnification of the image in the sub-scanning direction cannot be adjusted by adjusting the rotational speed of the secondary transfer roller. Therefore, in order to adjust the magnification in the sub-scanning direction without relying on the speed difference, it is necessary to perform image formation so as to cancel out the change in magnification in the sub-scanning direction.

Examples of the method of performing image formation so as to cancel out the change in magnification in the sub-scanning direction include an adjustment method of subjecting image data to be used for image formation to image processing to expand or contract the image data (digital sub-scanning scaling) and an adjustment method using a processing speed during image formation. When the adjustment method using the processing speed is performed, various image formation conditions are changed. Thus, a measurement image is formed on the intermediate transfer member, and the adjustment amount of the processing speed is feed-back controlled by measuring the size of the measurement image. This feed-back control is hereinafter referred to as "color registration". Through color registration, a series of operations for feed-back is necessary, and hence a downtime is caused in the image forming processing. Therefore, the measurement image used for adjustment of the image size is required to be formed at an optimum timing.

SUMMARY OF THE INVENTION

According to an embodiment of the present invention, there is provided an image forming apparatus, including: an image forming unit configured to form an image; an intermediate transfer member, onto which the image formed by the image forming unit is transferred, configured to convey the image; a transfer member configured to form a transfer nip portion for transferring the image formed on the intermediate transfer member onto a sheet; a speed controller configured to control a rotational speed of the transfer member based on information relating to the sheet; a measurement unit configured to measure a measurement image transferred onto the intermediate transfer member; and a controller configured to: control the image forming unit to form the measurement image; control the measurement unit to measure the measurement image; and determine an adjustment condition for adjusting a length of the image in a conveyance direction of the intermediate transfer member, based on a measurement result of the measurement unit, wherein, in a case where the rotational speed is changed from a first speed to a second speed, the controller controls whether or not to control the image forming unit to form the measurement image based on the first speed and the second speed.

Further features of the present invention will become apparent from the following description of exemplary embodiments (with reference to the attached drawings).

BRIEF DESCRIPTION OF THE DRAWINGS

FIG. 4A, FIG. 4B, FIG. 4C, and FIG. 4D are explanatory diagrams for illustrating setting of a print job.

DESCRIPTION OF THE EMBODIMENTS

Figure 1:
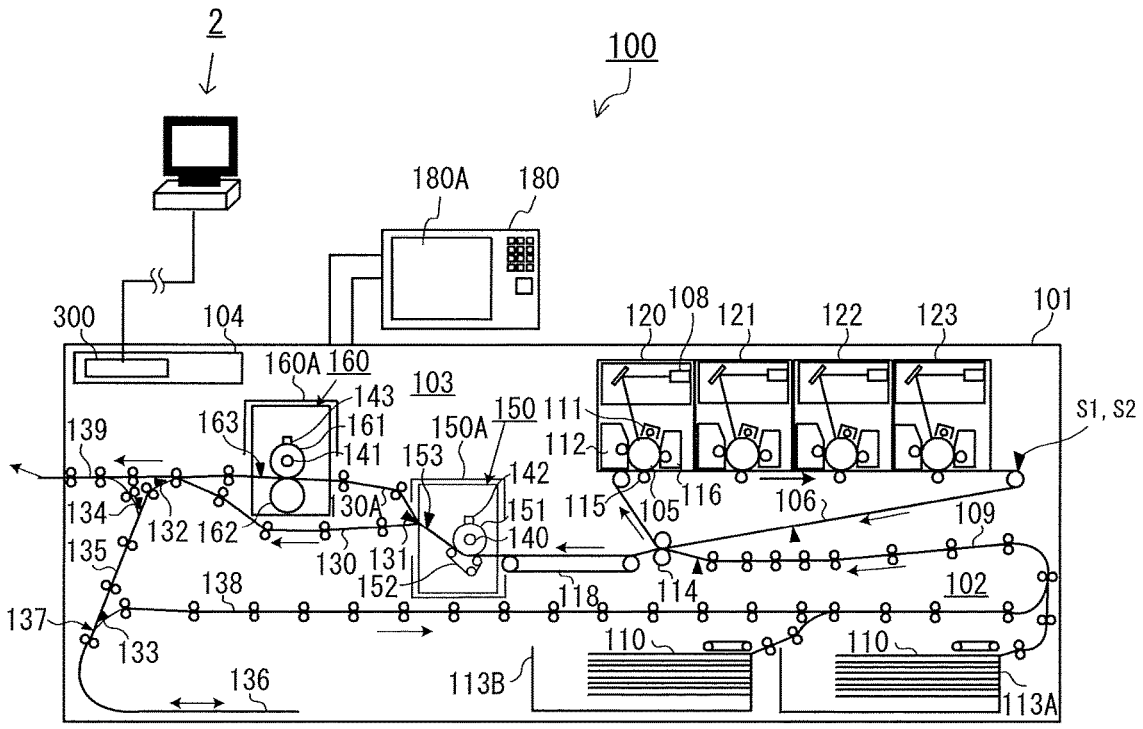
FIG. 1 is a configuration diagram of an image forming apparatus.

Now, referring to the drawings, an embodiment of the present invention is described in detail.

(Image Forming Apparatus)

FIG. 1 is a configuration diagram of an image forming apparatus of this embodiment. This image forming apparatus is a laser beam printer configured to perform electrophotographic image forming processing to form a full-color image on a sheet 110. An image forming apparatus 100 includes a casing 101, and an operation portion 180 including a display portion 180A. The display portion 180A is a touch panel-type flat panel display. The operation portion 180 includes the display portion 180A and a key button as an input device. The casing 101 includes a configurations for image forming processing and a control board accommodating portion 104 configured to accommodate therein a controller 300 configured to control the image forming processing. The controller 300 is connected to, for example, an external apparatus 2 such as a personal computer via a network, and is configured to acquire a print job including various settings, instructions, and image data for image formation from the external apparatus 2.

The casing 101 includes four image forming portions 120 to 123 configured to independently form toner images of four colors including three subtractive primary colors of yellow (Y), magenta (M), and cyan (C) in addition to black (K). Further, the casing 101 includes an intermediate transfer belt 106 serving as an intermediate transfer member, a sheet conveyance mechanism 102, and a fixing processing mechanism 103.

The image forming portions 120 to 123 are simply different in the color of a toner image to be formed, and have a similar configuration. For example, the image forming portion 120 includes a rotation-drum electrophotographic photosensitive member (hereinafter referred to as "photosensitive drum") 105, and a process mechanism configured to form a toner image on the photosensitive drum 105. The process mechanism includes a primary charging device 111, a laser scanner 108, a developing device 112, a primary transfer roller 115, and a photosensitive drum cleaner 116. In order to simplify the illustration, reference symbols of those components in each of the image forming portions 121, 122, and 123 of FIG. 1 are omitted.

The toner images of the respective colors formed on the photosensitive drums 105 of the respective image forming portions 120 to 123 are primarily transferred onto the intermediate transfer belt 106 sequentially in a superimposed manner. With this, a full-color toner image is formed on the intermediate transfer belt 106. The intermediate transfer belt 106 is an image bearing member configured to be rotationally driven in the clockwise direction in FIG. 1, and configured to bear a toner image to convey the image to a transfer portion for secondarily transferring the image onto the sheet 110. The toner image formed on the intermediate transfer belt 106 is transferred onto the sheet 110. The image creating principle, process, and operation in each of the image forming portions 120 to 123 are widely known, and hence detailed description thereof is omitted herein.

The sheet conveyance mechanism 102 includes a first sheet receiving member 113A, a second sheet receiving member 113B, and a conveyance path 109. The first sheet receiving member 113A and the second sheet receiving member 113B are each configured to receive the sheets 110. The sheet 110 is a recording medium including plain paper, cardboards, envelopes, postcards, labels, glossy paper, OHP sheets, resin sheets, printing sheets, and format sheets of various sizes. The sheet conveyance mechanism 102 is configured to feed the sheets 110 from the first sheet receiving member 113A or the second sheet receiving member 113B one by one. The sheet conveyance mechanism 102 is configured to convey the fed sheets 110 to the transfer portion along the conveyance path 109. The transfer portion includes the intermediate transfer belt 106 and a secondary transfer belt 114. The sheet conveyance mechanism 102 is configured to convey the sheet 110 to the transfer portion in synchronization with the timing to convey the toner image formed on the intermediate transfer belt 106 to the transfer portion. With this, the full-color toner image formed on the intermediate transfer belt 106 is transferred onto the sheet 110.

The sheet 110 having the toner image transferred thereon is separated from the intermediate transfer belt 106, and is then conveyed to the fixing processing mechanism 103 by a conveyance belt 118. The fixing processing mechanism 103 includes a first fixing device 150 and a second fixing device 160 each configured to heat and pressurize the toner image transferred onto the sheet 110, to thereby fix the toner image on the sheet 110. The first fixing device 150 includes a fixing roller 151 configured to heat the sheet 110, a pressure belt 152 configured to bring the sheet 110 into pressure-contact with the fixing roller 151, a first fixing sensor 153 configured to detect fixing completion, and a thermistor 142 to be used for control of a fixing temperature. The fixing roller 151 is a hollow roller, and includes a heater 140 therein. The second fixing device 160 is configured to apply gloss to the toner image formed on the sheet 110 that has been subjected to the fixing processing by the first fixing device 150, to thereby secure the fixing performance. The second fixing device 160 includes a fixing roller 161, a pressure roller 162, a second fixing sensor 163, and a thermistor 143 to be used for control of a fixing temperature. The fixing roller 161 is a hollow roller, and includes a heater 141 therein.

Each of the first fixing device 150 and the second fixing device 160 includes a pair of rotary members (fixing roller 151 and pressure belt 152, and fixing roller 161 and pressure roller 162) configured to fix the toner image formed on the sheet 110 by heat and pressure. For example, when a large amount of gloss is required to be applied to an image, or when a large amount of heat is required for fixing as in the case of a cardboard sheet, the sheet 110 that has passed through the first fixing device 150 passes along a conveyance path 130A to be conveyed to the second fixing device 160. When the sheet 110 is not required to be passed through the second fixing device 160, the sheet 110 is conveyed along a conveyance path 130 without passing through the second fixing device 160. For example, when the sheet 110 is plain paper or thin paper, and a large amount of gloss is not required to be applied, the sheet 110 that has passed through the first fixing device 150 is conveyed along the conveyance path 130. Therefore, the sheet 110 is not conveyed to the second fixing device 160. The sheet 110 is guided to any one of the conveyance path 130A and the conveyance path 130 by a first flapper 131.

After the sheet 110 is subjected to the fixing processing by the second fixing device 160, or after the sheet 110 is conveyed along the conveyance path 130, the sheet 110 is guided to any one of a conveyance path 135 and a delivery path 139 by a second flapper 132. The sheet 110 guided to the delivery path 139 is delivered outside the casing 101. The sheet 110 guided to the conveyance path 135 is conveyed to a reversing portion 136. When a reverse sensor 137 provided at the entrance part of the reversing portion 136 detects a trailing edge of the sheet 110, the conveyance direction of the sheet 110 is switched.

A third flapper 133 is configured to guide the sheet 110 whose conveyance direction is reversed by the reversing portion 136 to any one of the conveyance path 135 and a conveyance path 138 for duplex image formation. The sheet 110 guided to the conveyance path 138 is returned to the conveyance path 109 to be guided to the transfer portion again, to thereby form an image on a second surface of the reversed sheet. The sheet 110 conveyed to the conveyance path 135 is guided to the delivery path 139 by a fourth flapper 134 to be delivered outside the casing 101.

(Transfer Portion)

Figure 2:
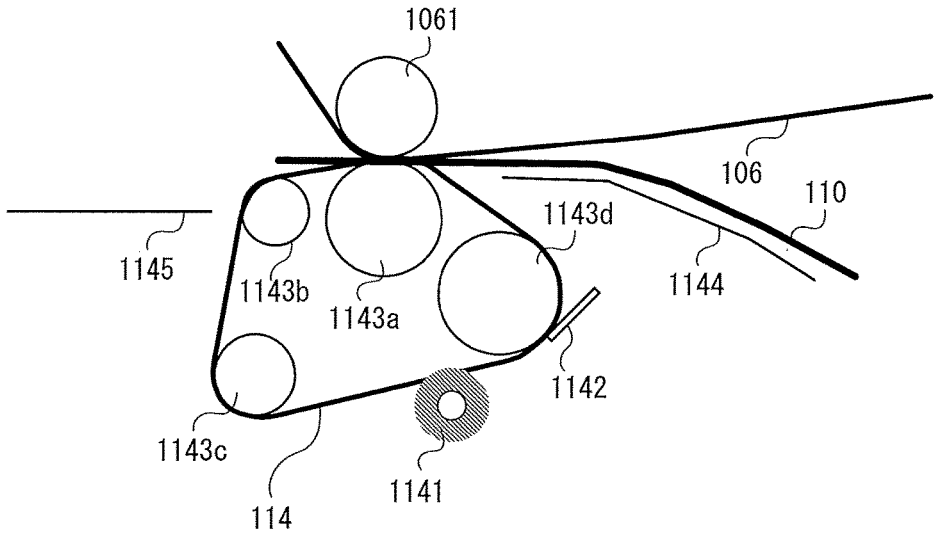
FIG. 2 is an enlarged view of a transfer portion.

FIG. 2 is an enlarged view of the transfer portion. A secondary transfer inner roller 1061 is in contact with the inner side of the intermediate transfer belt 106. When the toner image formed on the intermediate transfer belt 106 is transferred onto the sheet 110, a predetermined bias voltage is applied to the secondary transfer inner roller 1061.

A secondary transfer outer roller 1143*a* and tension rollers 1143*b*, 1143*c*, and 1143*d* are in contact with the inner side of the secondary transfer belt 114. The secondary transfer outer roller 1143*a* is electrically grounded. When the toner image formed on the intermediate transfer belt 106 is transferred onto the sheet 110, the secondary transfer belt 114 nips the sheet 110 together with the intermediate transfer belt 106 to transfer the toner image formed on the intermediate transfer belt 106 onto the sheet 110 by an electrostatic force. A secondary transfer cleaner fur 1141 and a secondary transfer cleaning blade 1142 are arranged on the outer periphery of the secondary transfer belt 114. The secondary transfer cleaner fur 1141 and the secondary transfer cleaning blade 1142 are a cleaning mechanism configured to collect the toner image when the toner image formed on the intermediate transfer belt 106 is directly transferred onto the secondary transfer belt 114.

The intermediate transfer belt 106 is rotated at a predetermined surface speed V1 by the secondary transfer inner roller 1061 that is rotationally driven by an intermediate transfer belt drive motor to be described later. The secondary transfer belt 114 is rotated at a predetermined surface speed V2 by the secondary transfer outer roller 1143*a* that is rotationally driven by a secondary transfer belt drive motor to be described later. The secondary transfer belt 114 is a conveyance member configured to convey the sheet 110 to the transfer portion, and hence the surface speed V2 corresponds to the conveyance speed of the sheet 110. As described above, the intermediate transfer belt 106 and the secondary transfer belt 114 can be independently and freely driven at any speed by different motors. When it is intended to stabilize geometric characteristics of the toner image formed on the sheet 110, the speed difference between the surface speeds V1 and V2 is reduced, and when it is intended to improve the image quality, for example, reduce the graininess, the speed difference between the surface speeds V1 and V2 is increased.

The sheet 110 fed through the conveyance path 109 is guided to the transfer portion by a secondary transfer front guide 1144. At the transfer portion, the toner image formed on the intermediate transfer belt 106 is transferred onto the sheet 110 under a predetermined speed difference between the intermediate transfer belt 106 and the secondary transfer belt 114, and the sheet 110 is then delivered to a secondary transfer rear guide 1145. The secondary transfer rear guide 1145 guides the sheet 110 to the conveyance belt 118.

(Controller)

Figure 3:
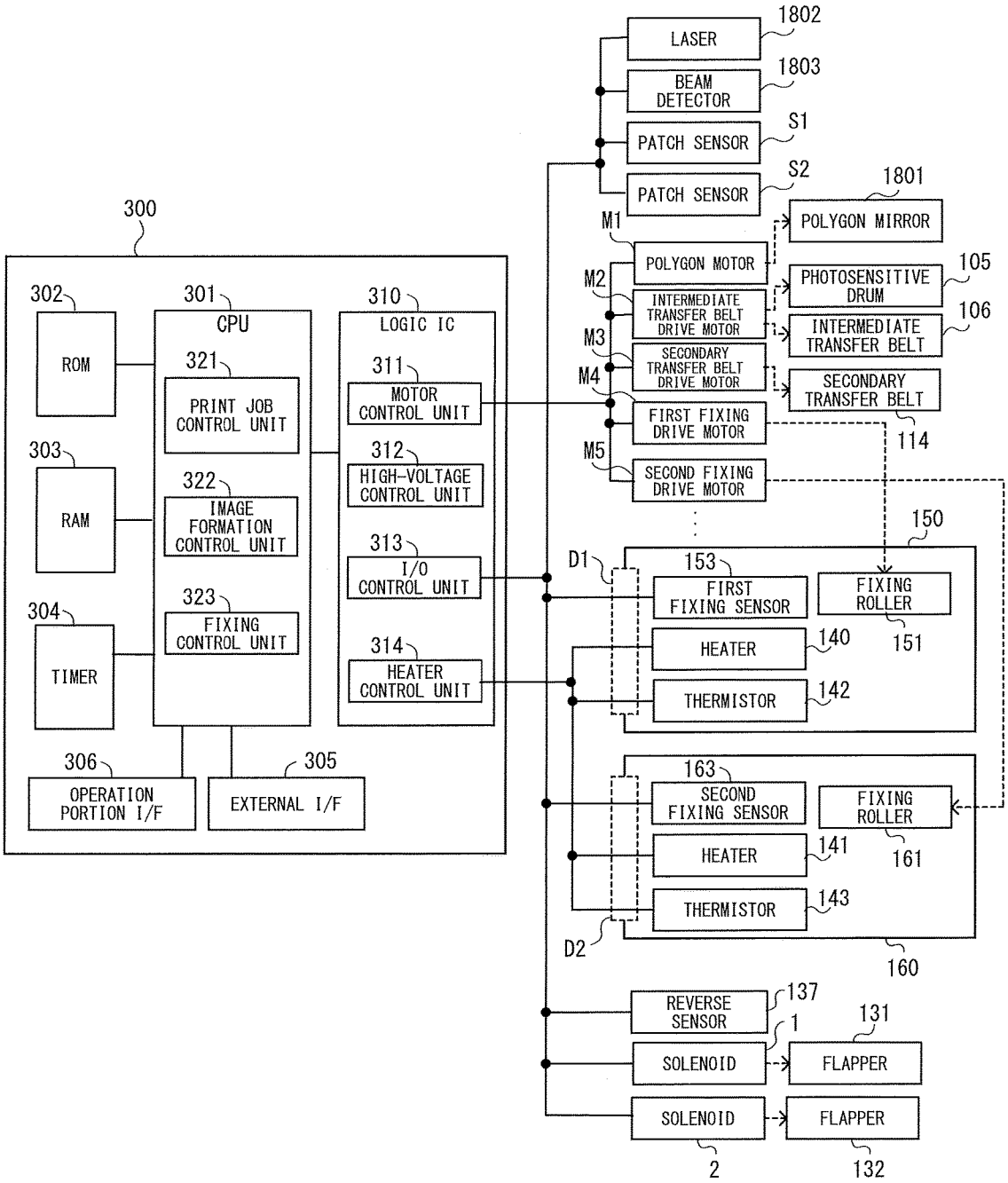
FIG. 3 is a configuration diagram of a controller.

FIG. 3 is a configuration diagram of the controller 300. The controller 300 includes a central processing unit (CPU) 301, a read only memory (ROM) 302, and a random access memory (RAM) 303. The CPU 301 is configured to read out a computer program from the ROM 302, and to execute the computer program with use of the RAM 303 as a system work memory. The CPU 301 is configured to control the operation of each portion inside the image forming apparatus 100. The controller 300 further includes a timer 304, an external I/F 305, an operation portion I/F 306, and a logic integrated circuit (IC) 310. The external I/F 305 is an interface configured to establish communication with the external apparatus 2. The operation portion I/F 306 is an interface configured to establish communication with the operation portion 180. The operation portion I/F 306 is configured to display a screen depending on the instruction from the CPU 301 on the display portion 180A of the operation portion 180, and to transmit the input from the touch panel to the CPU 301.

Through execution of the computer program, the CPU 301 functions as a print job control unit 321, an image formation control unit 322, and a fixing control unit 323. The print job control unit 321 is configured to analyze the print job and determine the order of the images to be formed. The image formation control unit 322 is configured to control the operation of each portion of the image forming apparatus 100, to thereby control image formation onto the sheet 110 and conveyance of the sheet 110. The fixing control unit 323 is configured to control fixing by the first fixing device 150 and the second fixing device 160.

The logic IC 310 functions as a motor control unit 311, a high-voltage control unit 312, an I/O control unit 313, and a heater control unit 314. The logic IC 310 is configured to operate depending on an instruction from the CPU 301. The high-voltage control unit 312 is configured to control high-voltage application for development, charging, transfer, and the like.

The motor control unit 311 is configured to control drive of various motors used inside the image forming apparatus 100. A polygon motor M1 is configured to rotationally drive a polygon mirror 1801. An intermediate transfer belt drive motor M2 is configured to rotationally drive the intermediate transfer belt 106 and the photosensitive drum 105. A secondary transfer belt drive motor M3 is configured to rotationally drive the drive roller 1143*a* for rotating the secondary transfer belt 114. A first fixing drive motor M4 is configured to rotationally drive the fixing roller 151 of the first fixing device 150. A second fixing drive motor M5 is configured to rotationally drive the fixing roller 161 of the second fixing device 160.

The I/O control unit 313 is connected to patch sensors S1 and S2, the first fixing sensor 153, the second fixing sensor 163, and the reverse sensor 137. The I/O control unit 313 is configured to notify the CPU 301 of the detection result of each sensor. The I/O control unit 313 is connected to solenoids 1 and 2 configured to control the first flapper 131 and the second flapper 132, respectively, a laser 1802, and a beam detector 1803. The I/O control unit 313 is configured to control those sensors, the solenoids 1 and 2, and the laser 1802 in accordance with the instruction from the CPU 301. The third flapper 133 and the fourth flapper 134 are each biased by a spring to be pushed upward upon entry of the leading edge of the sheet 110 so that the trailing edge of the sheet 110 proceeds to the switched destination. Therefore, those flappers do not require control by the controller 300.

The heater control unit 314 is connected to the heater 140 and the thermistor 142 of the first fixing device 150, and to the heater 141 and the thermistor 143 of the second fixing device 160. The heater control unit 314 is configured to control the fixing temperature of each of the first fixing device 150 and the second fixing device 160. The first fixing device 150 and the second fixing device 160 are electrically connected to the controller 300 via drawer connectors D1 and D2, respectively.

FIG. 4A to FIG. 4D are explanatory diagrams for illustrating setting of a print job. FIG. 4A to FIG. 4C are exemplary diagrams of a setting screen for setting the print job, which is to be displayed on the display portion 180A of the operation portion 180. FIG. 4D is a table for showing a fixing temperature and a speed difference with respect to a basis weight of the sheet 110. This table is stored in, for example, the ROM 302. The setting screen to be displayed on the display portion 180A by the CPU 301 includes various operation buttons (key buttons). The user operates the operation buttons to perform setting of the sheet 110, such as determining conditions of the print job.

Conditions of the print job and sheet attributes of the sheet 110 are stored in the RAM 303. The user can set the sheet attribute with the screens illustrated in FIG. 4A and FIG. 4C, and the user can set the conditions of the print job with the screen illustrated in FIG. 4B. The sheet attribute is information relating to the sheet 110, such as the basis weight of the sheet 110, the type and size of the sheet 110, and the expanding/contracting amount of the sheet 110 in the conveyance direction.

When the user operates a "−" key 1801 and a "+" key 1802 on the setting screen of FIG. 4A, the basis weight of the sheet 110 can be set. When the user operates an "OK" key 1804, the basis weight being the sheet attribute can be changed. When canceling the change of the basis weight, the user operates a "cancel" key 1803.

With the setting screen of FIG. 4B, the user can set the operation mode for optimizing the print job. In this embodiment, several patterns of operation modes can be selected depending on the basis weight of the sheet 110 set in FIG. 4A. In this case, as the operation mode, an image quality priority mode that gives priority to image quality, or a productivity priority mode that gives priority to productivity can be selected.

In such a print job that includes thin sheets and cardboards in a mixed manner, in the case of the image quality priority mode, the fixing temperature is switched so that each sheet can have an optimum gloss. Therefore, a downtime is caused until the fixing temperature reaches a predetermined temperature. In the case of the productivity priority mode, the print job is executed at the same fixing temperature, and hence the downtime due to switching of the fixing temperature is not caused. However, the image quality of the image formed in the productivity priority mode does not have an optimum gloss. The user can select the productivity priority mode with a "productivity priority" button 1805 on the setting screen of FIG. 4B, or can select the image quality priority mode with an "image quality priority" button 1806. When reflecting the selection result, the user operates an "OK" key 1808. When canceling the selection, the user operates a "cancel" key 1807.

FIG. 4D is a table for showing the fixing temperature and the speed difference of each of the image quality priority mode and the productivity priority mode, in which the basis weight of 150 [gsm] is set as a boundary. The basis weight herein refers to the weight of the sheet per square meter. The speed difference is represented as an offset amount from 100[%] corresponding to (surface speed V1 of intermediate transfer belt 106)/(surface speed V2 of secondary transfer belt 114). For example, the speed difference of 1.50[%] means that the surface speed V1 of the intermediate transfer belt 106 is higher by 1.50[%] than the surface speed V2 of the secondary transfer belt 114.

The image forming apparatus 100 of this embodiment is configured to switch the fixing temperature and change the speed difference based on the basis weight of the sheet 110 of 150 [gsm] as a reference. Therefore, even when the sheets 110 have mixed basis weights, the optimum image quality can be obtained while maintaining the productivity. In the image quality priority mode, the fixing temperature and the speed difference are changed depending on the basis weight, and thus an image with high image quality can be formed. In the productivity priority mode, the fixing temperature and the speed difference are the same regardless of the basis weight.

With the setting screen of FIG. 4C, the user can set the adjustment amount of the surface speed V2 of the secondary transfer belt 114. The user selects a positive or negative sign of the adjustment amount by a "±" key 1811, and operates a "−" key 1812 or a "+" key 1813 to freely change the surface speed V2 of the secondary transfer belt 114. When changing the surface speed V2 of the secondary transfer belt 114 being the sheet attribute, the user operates an "OK" key 1815. When canceling the change, the user operates a "cancel" key 1814.

In the example of FIG. 4C, the adjustment amount of the speed of the secondary transfer belt 114 is set within a range of from "−3" to "+3". The speed of the secondary transfer belt 114 is offset by 0.05[%] per level with respect to the speed difference determined based on the table of FIG. 4D. For example, referring to the table, in the image quality priority mode, the speed difference of thick plain paper having the basis weight of 160 [gsm] is 1.50[%]. When "+3" is set for reducing the "graininess" of the image on the setting screen of FIG. 4C, the speed difference of 1.65[%], which is offset by 0.15[%] with respect to the speed difference of 1.50[%], is set.

The image forming apparatus 100 is configured to subject an image to sub-scanning scaling (digital scaling in the sheet conveyance direction in which the sheet 110 is conveyed), to thereby cancel out such image magnification change that the image transferred onto the sheet 110 at the transfer portion is expanded or contracted in the sub-scanning direction (sheet conveyance direction). With this, regardless of whether or not there is a speed difference between the surface speed of the intermediate transfer belt 106 and the surface speed of the secondary transfer belt 114, an image without expansion or contraction can be obtained. Examples of the sub-scanning scaling include "digital sub-scanning scaling" performed by correcting image data that indicates an image, and "polygon sub-scanning scaling" performed by controlling laser light when an image is formed onto the photosensitive drum 105. The speed difference can be converted into the adjustment amount for the sub-scanning magnification with use of, for example, a predetermined arithmetic expression or a table.

(Digital Sub-Scanning Scaling)

Figure 5A:
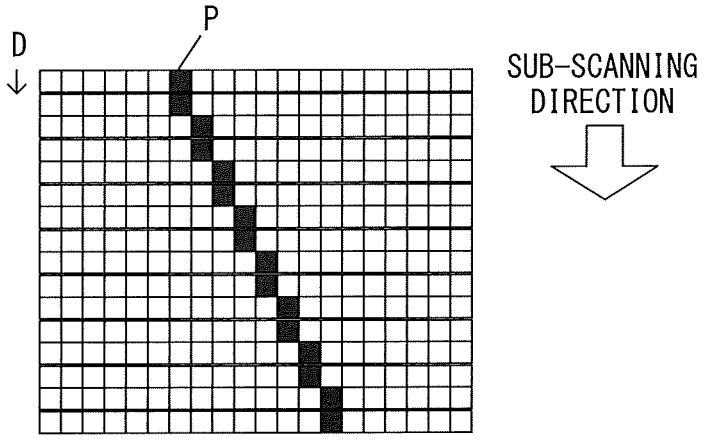
FIG. 5A and FIG. 5B are explanatory diagrams for illustrating digital sub-scanning scaling.
Figure 5B:
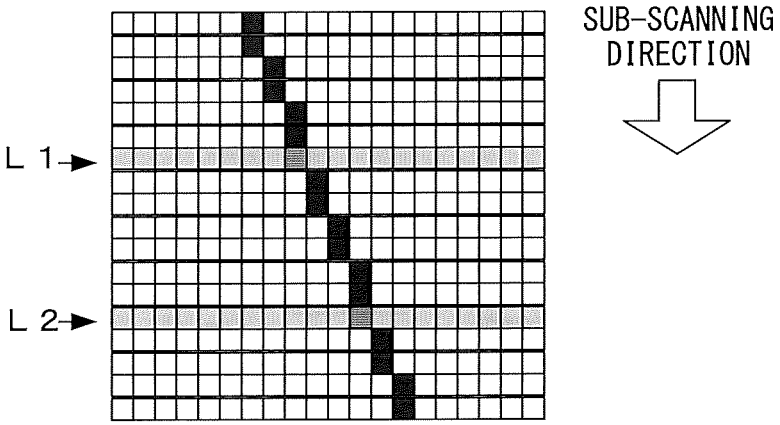

FIG. 5A and FIG. 5B are explanatory views for illustrating the digital sub-scanning scaling. Referring to FIG. 5A and FIG. 5B, description is given of an example in which the digital sub-scanning scaling is performed on an image having 600 [dot per inch (dpi)] in the main scanning direction and the sub-scanning direction. One pixel P of the image of FIG. 5A has a length in the sub-scanning direction of D=25.4 [mm]/600 [dpi]=0.0423 [mm].

In the case of the digital sub-scanning scaling for expanding the image of FIG. 5A in the sub-scanning direction as illustrated in FIG. 5B, pixel lines L1 and L2 are inserted in the sub-scanning direction at predetermined intervals. The pixel line of this embodiment includes pixels for one line in the main scanning direction and one pixel in the sub-scanning direction. A plurality of pixels may be arranged in the sub-scanning direction as long as the image does not collapse. For example, when an A3-sized image (having a length in the sub-scanning direction of 420 [mm]) is subjected to digital sub-scanning scaling into 100.5[%], the length in the sub-scanning direction of the image subjected to scaling is 422.1 [mm]. In this case, pixel lines of 50 pixels, which correspond to 2.1 [mm], are inserted in the sub-scanning direction. Various algorithms for determining where to insert the pixel lines in the sub-scanning direction have been made public. The A3-sized sheet 110 has a length in the sub-scanning direction of 420 [mm], which corresponds to 9,921 pixels, and hence one pixel line may be simply inserted for every 198 pixels in the sub-scanning direction. The controller 300 is configured to correct the image data so as to insert the pixel lines into the image. With such correction of the image data, the contraction of the image in the sub-scanning direction, which is caused by the speed difference at the transfer portion, can be canceled out. In the case of the digital sub-scanning scaling for contracting the image in the sub-scanning direction, the pixel lines may be removed in the sub-scanning direction at predetermined intervals.

(Polygon Sub-Scanning Scaling)

Figure 6A:
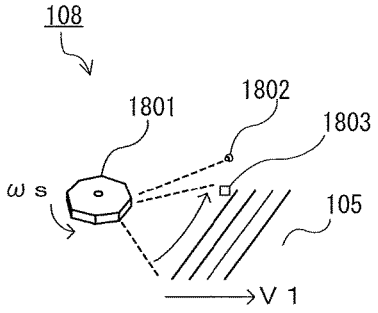
FIG. 6A and FIG. 6B are explanatory diagrams for illustrating polygon sub-scanning scaling.
Figure 6B:
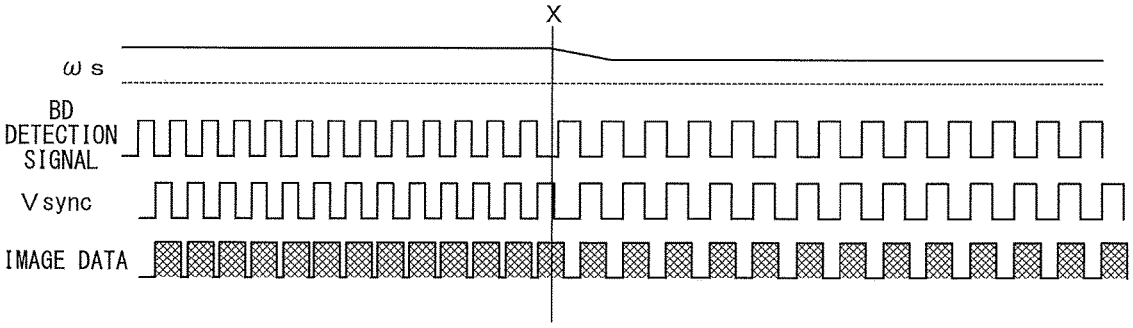

FIG. 6A and FIG. 6B are explanatory diagrams for illustrating the polygon sub-scanning scaling. In the polygon sub-scanning scaling, the scanning speed (the rotational speed of the polygon mirror) when the laser scanner 108 exposes the surface of the photosensitive drum 105 to laser light can be changed, to thereby change the magnification in the sub-scanning direction of the image to be formed on the photosensitive drum 105.

FIG. 6A is an explanatory diagram for illustrating a state in which laser light emitted from the laser scanner 108 scans the surface of the photosensitive drum 105 (photosensitive member). The laser scanner 108 includes the laser 1802 serving as a light source, and the polygon mirror 1801 serving as a rotary polygon mirror. The direction in which the laser 1802 scans the surface of the photosensitive drum 105 corresponds to the main scanning direction. The direction orthogonal to the main scanning direction corresponds to the sub-scanning direction.

The laser 1802 is configured to emit laser light controlled based on the image data. The polygon mirror 1801 rotates at an angular velocity ωs in a counterclockwise direction in FIG. 6A, to thereby deflect the laser light emitted from the laser 1802 toward the photosensitive drum 105. The direction to deflect the laser light changes depending on the rotation of the polygon mirror 1801, and hence the laser light scans the photosensitive drum 105 in a line shape from the front side to the deep side in FIG. 6A. The beam detector 1803 is arranged in a non-image region of the photosensitive drum 105. In synchronization with the detection of the laser light with the beam detector 1803, an electrostatic latent image of the next one line is formed in the main scanning direction. The surface of the photosensitive drum 105 proceeds at the same speed as the surface speed V1 of the intermediate transfer belt 106, and the formation of the electrostatic latent image in the main scanning direction is repeated, to thereby form the electrostatic latent image in the sub-scanning direction of the photosensitive drum 105.

FIG. 6B is a timing chart of scanning by the laser light. In synchronization with a detection signal (BD detection signal) of the beam detector 1803, a vertical synchronization signal Vsync is generated. The laser 1802 is configured to emit laser light based on the image data in the unit of lines in synchronization with the vertical synchronization signal Vsync. When the angular velocity ωs of the polygon mirror 1801 is decreased at a timing X, the detection period of the beam detector 1803 is increased. In the case where the surface speed V1 of the photosensitive drum 105 is constant, the interval of the respective lines is extended when the detection period of the beam detector 1803 is increased. With this, the sub-scanning magnification of the electrostatic latent image is increased. With the control of the rotational speed of the polygon mirror 1801, the contraction of the image in the sub-scanning direction, which is caused by the speed difference at the transfer portion, can be canceled out. In the case of the polygon sub-scanning scaling for contraction in the sub-scanning direction, the angular velocity ωs of the polygon mirror 1801 may be increased.

As described above, the image forming apparatus 100 is configured to change the rotational speed (angular velocity ωs) of the polygon mirror 1801 to change the sub-scanning magnification, thereby performing the polygon sub-scanning scaling. The image forming apparatus 100 performs polygon sub-scanning scaling with use of feed-back control of the angular velocity ωs of the polygon mirror 1801, which is a known technology. When a parameter that depends on the sub-scanning magnification, such as the angular velocity ωs, is to be changed based on the feed-back residual of the angular velocity ωs of the polygon mirror 1801, it is common to perform so-called "color registration" in order to maintain the image geometric accuracy. In other words, the color registration suppresses the misregistration of the image in the sub-scanning direction, which is caused by the change in angular velocity of the polygon mirror 1801 during the polygon sub-scanning scaling.

Figure 7A:
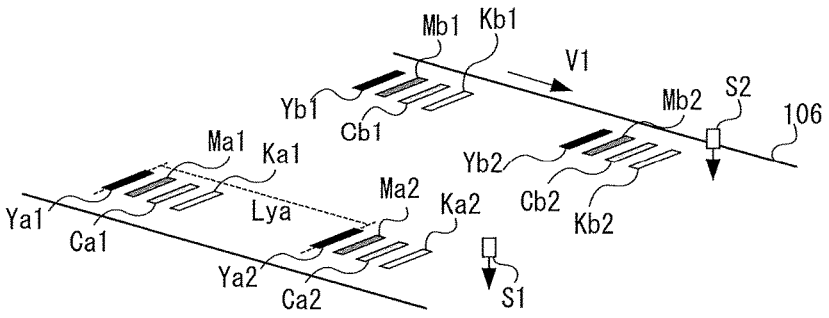
FIG. 7A and FIG. 7B are explanatory diagrams for illustrating color registration.
Figure 7B:
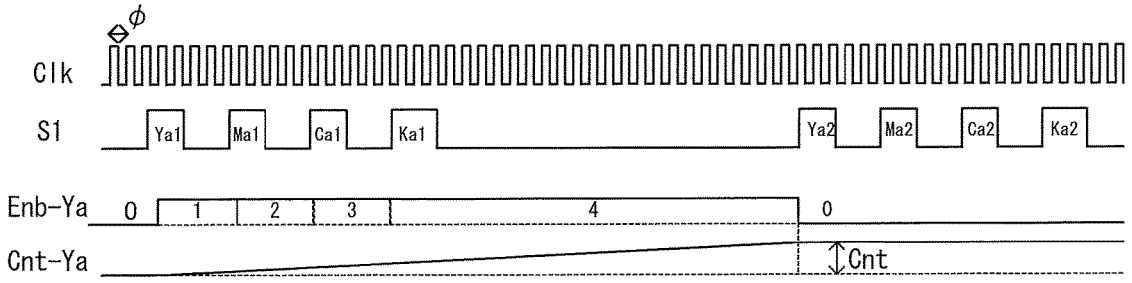

FIG. 7A and FIG. 7B are explanatory diagrams for illustrating the color registration. FIG. 7A is an explanatory diagram for illustrating measurement images to be used for the color registration. FIG. 7B is a timing chart of the color registration.

In the color registration, various image geometric characteristics such as color misregistration, inclination, and main-scanning magnification of each of the image forming portions 120 to 123 are corrected. Now, description is given of the detection and correction of the sub-scanning magnification of the yellow (Y) image. In FIG. 7A, the intermediate transfer belt 106 moves from the deep left side toward the front right side. The intermediate transfer belt 106 is driven at the surface speed V1. In the color registration, on the intermediate transfer belt 106, automatic registration patches Ya1, Ya2, Ma1, Ma2, Ca1, Ca2, Ka1, Ka2, Yb1, Yb2, Mb1, Mb2, Cb1, Cb2, Kb1, and Kb2 are formed as measurement images. The patch sensors S1 and S2 are configured to measure those automatic registration patches. When the yellow (Y) sub-scanning magnification is detected and corrected, the patch sensor S1 measures the automatic registration patches Ya1 and Ya2, and the patch sensor S2 measures the automatic registration patches Yb1 and Yb2.

In synchronization with the rising edge of the binary measurement result of the patch sensor S1, a yellow (Y) fount-side counter enable Enb-Ya counts up. While the patch sensor S1 measures the automatic registration patch Ya1 and then measures the automatic registration patch Ya2, a yellow (Y) front-side counter counts a sampling clock Clk. The period of the sampling clock Clk is represented by "φ", and the count value is represented by "Cnt-Ya".

A distance Lya from the automatic registration patch Ya1 to the automatic registration patch Ya2 on the intermediate transfer belt 106 of FIG. 7A is obtained by Expression 1. When a target length from the automatic registration patch Ya1 to the automatic registration patch Ya2 is set to "Ly", a sub-scanning magnification Mag_y is obtained by Expression 2. The sub-scanning magnification Mag_y is used for fine adjustment of the angular velocity ωs or final adjustment of the digital sub-scanning scaling described with reference to FIG. 5A and FIG. 5B.

$$Lya = V1 * \mathrm{Cnt} * \varphi \quad \text{(Expression 1)}$$

$$\mathrm{Mag_}y = Ly/Lya \quad \text{(Expression 2)}$$

For example, when the A3-sized image (having the length in the sub-scanning direction of 420 [mm]) is changed in sub-scanning magnification to 100.5[%], the length of the image in the sub-scanning direction is 422.1 [mm]. At this time, the angular velocity of the polygon mirror 1801 is changed to ωs'=100×ωs/100.5.

With such polygon sub-scanning scaling, the length of the image in the sub-scanning direction becomes 422.05779 [mm] (99.99[%]) with respect to the target length of the image in the sub-scanning direction of 422.1 [mm] in A3 scale. Therefore, through the color registration, the angular velocity of the polygon mirror 1801 is corrected to ωs"=100×ωs'/99.99. Alternatively, the length may be contracted by 99.99[%] through digital sub-scanning scaling.

The digital sub-scanning scaling performs only expansion or contraction in the sub-scanning direction of the image data. Therefore, while the speed is increased, image defects such as jaggies and moire may be caused unless an algorism is devised. In view of this, the digital sub-scanning scaling is suitable for fine sub-scanning scaling.

The polygon sub-scanning scaling performs expansion or contraction of the image in the sub-scanning direction in an analog way. Therefore, the image quality is less liable to collapse as compared to the digital sub-scanning scaling even when scaling is performed in a larger amount. However, the angular velocity ωs of the polygon mirror 1801 is changed, and hence the polygon sub-scanning scaling cannot be executed during image formation, and a certain amount of downtime is caused, for example, between one image forming period and the next image forming period. Further, in order to obtain stable image geometric characteristics, the polygon sub-scanning scaling is desired to be executed together with the color registration as a set. In this case, it is required to form the measurement images for the color registration on the intermediate transfer belt 106, and then perform feed-back control and cleaning of the secondary transfer belt 114. Thus, a large downtime is caused.

(Sub-Scanning Scaling Processing)

Figure 8:
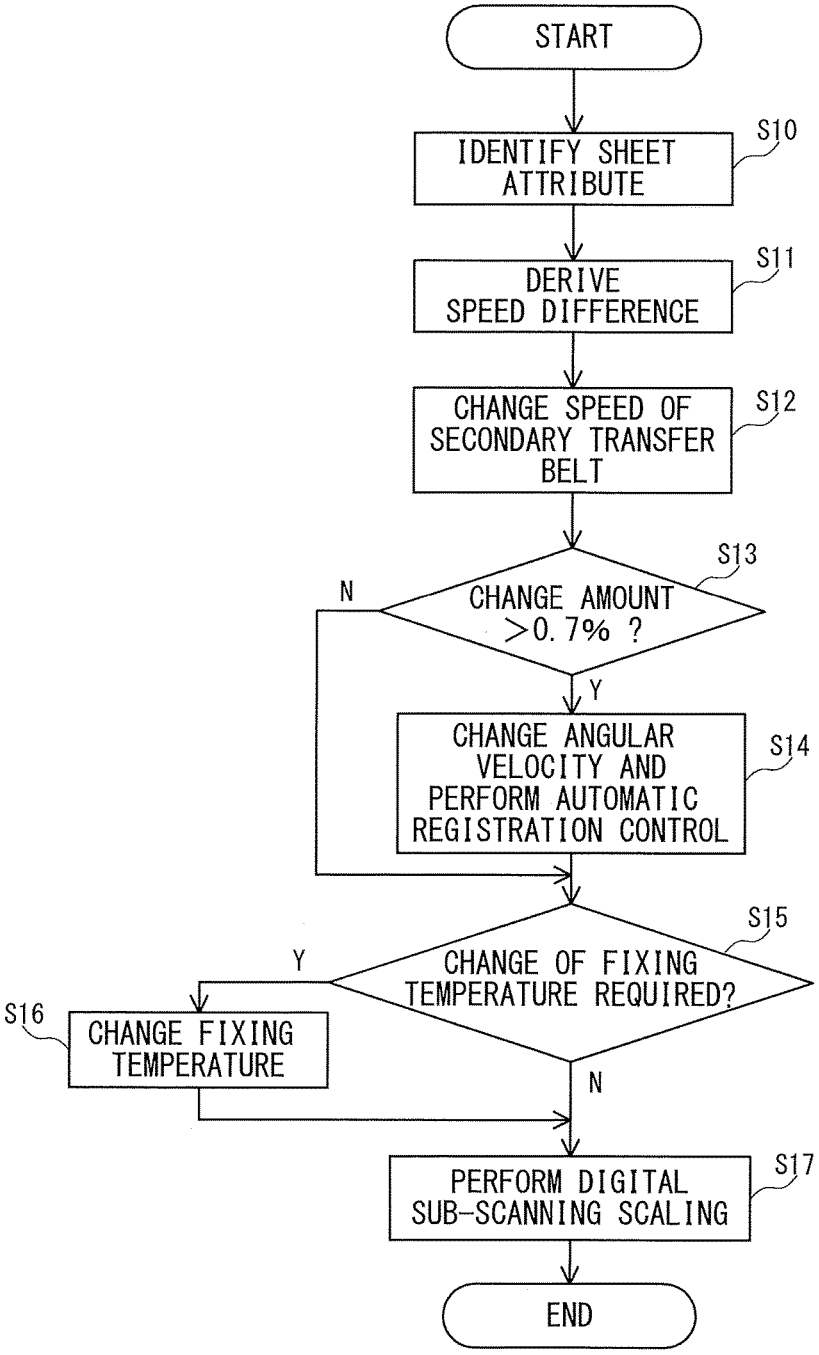
FIG. 8 is a flow chart for illustrating processing of speed switching of a secondary transfer belt and sub-scanning scaling.

FIG. 8 is a flowchart for illustrating processing of speed switching of the secondary transfer belt 114 and sub-scanning scaling.

The CPU 301 identifies the sheet attribute of the sheet 110 (S10). The CPU 301 determines the basis weight of the sheet 110 to be used based on the sheet attribute, and refers to the table of FIG. 4D to derive the speed difference based on the mode selected by the user (S11). The CPU 301 changes the surface speed of the secondary transfer belt 114 so that a speed corresponding to the derived speed difference is achieved (S12). The CPU 301 determines whether or not to perform the polygon sub-scanning scaling depending on whether the change amount of the surface speed of the secondary transfer belt 114 is larger than a predetermined threshold (predetermined amount). In this embodiment, the threshold is set to 0.7[%]. When the change amount of the surface speed is larger than 0.7[%] (S13: Y), the CPU 301 changes the angular velocity ωs of the polygon mirror 1801 to perform the color registration (S14). In the processing of Step S14, the CPU 301 determines the angular velocity ωs of the polygon mirror 1801 based on the scaling amount (or scaling ratio) in the sub-scanning direction, which is set for each type of sheet by the user. The color registration is executed under a state in which the angular velocity ωs of the polygon mirror 1801 is controlled to an angular velocity suitable for an image of the next page. In this manner, the polygon sub-scanning scaling and the color registration are performed. As described above, the image quality is less liable to collapse in the polygon sub-scanning scaling even when scaling is performed in a large amount. In this case, the change amount of the surface speed of the secondary transfer belt 114 is large, and hence the polygon sub-scanning scaling is performed for compensation.

Meanwhile, when the change amount of the surface speed is equal to or less than the threshold (equal to or less than the predetermined amount), that is, equal to or less than 0.7[%] (S13: N), the angular velocity ωs of the polygon mirror 1801 is not changed, and the color registration is not performed. Next, the CPU 301 refers to the table of FIG. 4D to confirm whether or not the change of the fixing temperature is required (S15). When the change of the fixing temperature is required (S15: Y), the CPU 301 changes the fixing temperature of each of the first fixing device 150 and the second fixing device 160 (S16). After the fixing temperature of each of the first fixing device 150 and the second fixing device 160 is set through the processing of Step S15 and Step S16, the CPU 301 performs digital sub-scanning scaling by correcting the image data, to thereby finely adjust the length in the sub-scanning direction of the image to be formed (S17). In the processing of Step S17, the CPU 301 executes the color registration to calculate the sub-scanning magnification Mag_y, and executes the digital sub-scanning scaling processing based on the sub-scanning magnification Mag_y.

As described above, when the size in the sub-scanning direction of the image to be formed is changed due to the change in surface speed of the secondary transfer belt 114, and when the change amount is larger than the predetermined amount, the CPU 301 adjusts the size of the image in the sub-scanning direction by polygon sub-scanning scaling and digital sub-scanning scaling. When the change amount is equal to or less than the predetermined amount, the CPU 301 adjusts the size of the image in the sub-scanning direction only by digital sub-scanning scaling. In other words, when the color registration is executed, the CPU 301 controls the angular velocity ωs of the polygon mirror 1801 based on the scaling amount (or scaling ratio) in the sub-scanning direction, and further executes the digital sub-scanning scaling processing based on the result of the color registration. Further, when the color registration is not executed, the CPU 301 executes the digital sub-scanning scaling processing based on the scaling amount (or scaling ratio) in the sub-scanning direction. As described above, the CPU 301 can execute processing depending on the change amount of the surface speed of the secondary transfer belt 114.

Figure 9A:
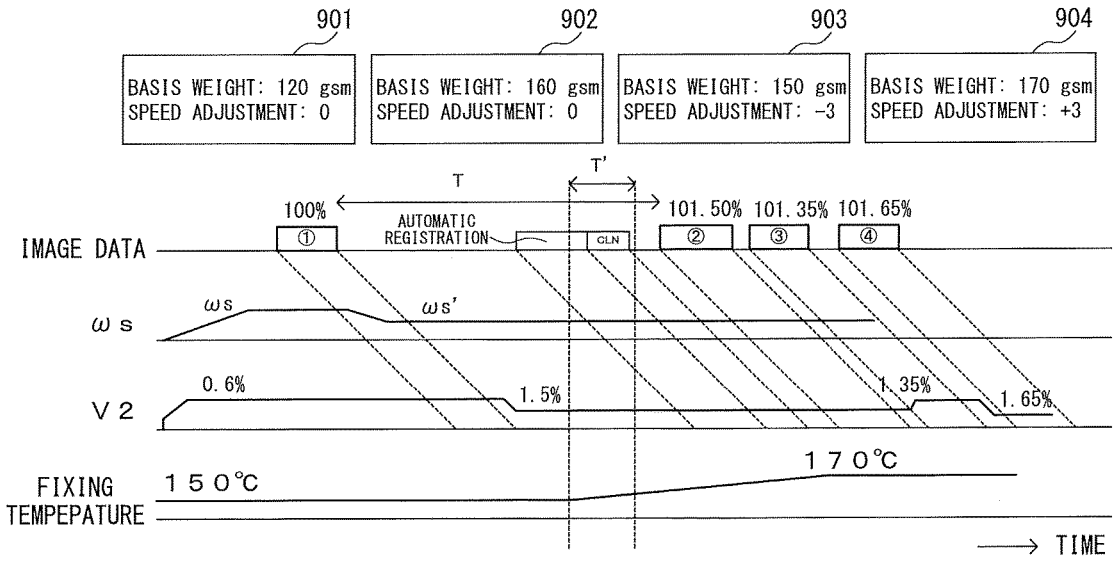
FIG. 9A and FIG. 9B are timing charts for execution of a print job.
Figure 9B:
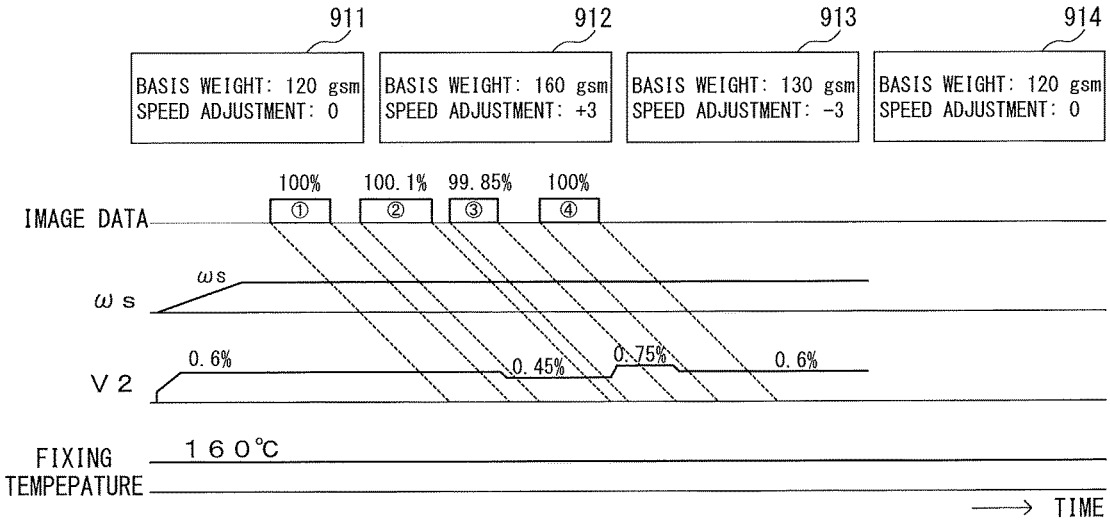

FIG. 9A and FIG. 9B are timing charts for execution of a print job.

FIG. 9A is an example of executing a print job in the image quality priority mode based on first to fourth image data 901 to 904 in each of which sheet attribute is set.

The first image data 901 has a basis weight of 120 [gsm] and an adjustment amount of the surface speed V2 of the secondary transfer belt 114 of "0". The CPU 301 forms an image that is based on the first image data 901 at a speed difference of 0.60[%] and a fixing temperature of 150[° C.] based on the table of FIG. 4D. The surface speed V2 of the secondary transfer belt 114 is not changed, and hence the CPU 301 does not perform polygon sub-scanning correction or color registration, but only performs digital sub-scanning scaling to adjust the magnification in the sub-scanning direction of the image to be formed.

The second image data 902 has a basis weight of 160 [gsm] and an adjustment amount of the surface speed V2 of the secondary transfer belt 114 of "0". The CPU 301 forms an image that is based on the second image data 902 at a speed difference of 1.50[%] and a fixing temperature of 170[° C.] based on the table of FIG. 4D. After the sheet passes through the transfer portion in the image forming processing based on the first image data 901, the CPU 301 changes the surface speed V2 of the secondary transfer belt 114 depending on the speed difference. In this case, the speed difference is changed by 0.7[%] or more, and hence the CPU 301 performs polygon sub-scanning correction and color registration in Step S13 and Step S14 of FIG. 8.

The load torque to be applied to the intermediate transfer belt 106 changes depending on the change in surface speed of the secondary transfer belt 114, and hence the color registration is preferred to be performed after the surface speed of the secondary transfer belt 114 is changed. In parallel therewith, after the sheet subjected to image formation based on the first image data 901 passes through the first fixing device 150, the CPU 301 changes the fixing temperature of each of the first fixing device 150 and the second fixing device 160 to 170[° C.].

The third image data 903 has a basis weight of 150 [gsm] and an adjustment amount of the surface speed V2 of the secondary transfer belt 114 of "−3". With the third image data 903, an image is formed at a speed difference of 1.35[%] and a fixing temperature of 170[° C.]. The fourth image data 904 has a basis weight of 170 [gsm] and an adjustment amount of the surface speed V2 of the secondary transfer belt 114 of "+3". With the fourth image data 904, an image is formed at a speed difference of 1.65[%] and a fixing temperature of 170[° C.]. In each case, the change in surface speed V2 of the secondary transfer belt 114 is less than 0.7[%] as compared to that during image formation based on the previous image data. Therefore, the CPU 301 does not perform polygon sub-scanning correction or color registration, but only performs digital sub-scanning scaling to adjust the magnification in the sub-scanning direction of the image to be formed.

As described above, in the image quality priority mode, the surface speed of the secondary transfer belt 114 is determined while giving priority to the image quality, and the magnification in the sub-scanning direction is finely adjusted by performing color registration as well. Therefore, an image with satisfactory geometric characteristics can be obtained. However, a downtime T is caused due to the sub-scanning correction. However, the switching of the fixing temperature and the change of the surface speed of the secondary transfer belt 114 are performed depending on the basis weight of the sheet, and hence the downtime due to the color registration and the downtime due to the switching of the fixing temperature overlap with each other. Therefore, as compared to a case where the color registration and the switching of the fixing temperature are separately performed, the downtime can be reduced by a time T'.

FIG. 9B is an example of executing a print job in the productivity priority mode based on the first to fourth image data 911 to 914 in each of which sheet attribute is set.

The first image data 911 has a basis weight of 120 [gsm] and an adjustment amount of the surface speed V2 of the secondary transfer belt 114 of "0". The CPU 301 forms an image that is based on the first image data 911 at a speed difference of 0.60[%] and a fixing temperature of 160[° C.] based on the table of FIG. 4D. The surface speed V2 of the secondary transfer belt 114 is not changed, and hence the CPU 301 does not perform polygon sub-scanning correction or color registration, but only performs digital sub-scanning scaling to adjust the magnification in the sub-scanning direction of the image to be formed.

The second image data 912 has a basis weight of 160 [gsm] and an adjustment amount of the surface speed V2 of the secondary transfer belt 114 of "+3". The CPU 301 forms an image that is based on the second image data 912 at a speed difference of 0.45[%] and a fixing temperature of 160[° C.] based on the table of FIG. 4D and the adjustment amount of the surface speed V2. After the sheet passes through the transfer portion in the image forming processing based on the first image data 911, the CPU 301 changes the surface speed V2 of the secondary transfer belt 114 depending on the speed difference. The change in surface speed V2 of the secondary transfer belt 114 is less than 0.7[%]. Therefore, the CPU 301 does not perform polygon sub-scanning correction or color registration, but performs only digital sub-scanning scaling to adjust the magnification in the sub-scanning direction of the image to be formed.

The third image data 913 has a basis weight of 130 [gsm] and an adjustment amount of the surface speed V2 of the secondary transfer belt 114 of "−3". With the third image data 913, an image is formed at a speed difference of 0.75[%] and a fixing temperature of 160[° C.]. The fourth image data 914 has a basis weight of 120 [gsm] and an adjustment amount of the surface speed V2 of the secondary transfer belt 114 of "0". With the fourth image data 914, an image is formed at a speed difference of 0.60[%] and a fixing temperature of 160[° C.]. In each case, the change in surface speed V2 of the secondary transfer belt 114 is less than 0.7[%] as compared to that during image formation based on the previous image data. Therefore, the CPU 301 does not perform polygon sub-scanning correction or color registration, but only performs digital sub-scanning scaling to adjust the magnification in the sub-scanning direction of the image to be formed.

As described above, in the productivity priority mode, although the image quality does not reach the highest image quality that can be obtained in the image quality priority mode, a reasonable image quality can be maintained, and a downtime is not caused. Thus, the highest productivity that the image forming apparatus 100 has can be obtained.

As described above, in the image forming apparatus 100 of this embodiment, the user can select any one of the image quality priority mode and the productivity priority mode depending on the desired image quality and productivity, and thus an image forming apparatus having high usability can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-163009, filed Aug. 20, 2015, which is hereby incorporated by reference wherein in its entirety.

What is claimed is:

1. An image forming apparatus, comprising:

an image forming unit configured to form an image;

a first transfer member, onto which the image formed by the image forming unit is transferred, configured to convey the image;

a second transfer member configured to form a transfer nip portion for transferring the image formed on the first transfer member onto a sheet;

a speed controller configured to control a conveyance speed of the first transfer member and a rotational speed of the second transfer member;

a measurement unit configured to measure a measurement image transferred onto the first transfer member; and a controller configured to:

control the image forming unit to form the measurement image;

control the measurement unit to measure the measurement image; and determine an adjustment condition for adjusting a length of an image that is to be transferred on the first transfer member in a conveyance direction of the first transfer member, based on a measurement result of the measurement unit, wherein the speed controller controls the rotational speed of the second transfer member based on information relating to the sheet, wherein, in a case where the rotational speed of the second transfer member is changed while the conveyance speed of the from a first transfer member is maintained at a predetermined conveyance speed, the controller controls whether or not to control the image forming unit to form the measurement image based on the rotational speed of the second transfer member.

2. The image forming apparatus according to claim 1, further comprising:

an input unit configured to input an adjustment amount for adjusting the rotational speed of the second transfer member; and wherein the speed controller controls the rotational speed of the second transfer member based on the information and the adjustment amount.

3. The image forming apparatus according to claim 1, further comprising a storage unit configured to store a correspondence relationship between the information relating to the sheet and data relating to the rotational speed.

4. The image forming apparatus according to claim 1, wherein the second transfer member includes a belt.

5. The image forming apparatus according to claim 1, wherein a surface speed of the first transfer member is higher than a surface speed of the second transfer member.

6. The image forming apparatus according to claim 1, wherein the information relating to the sheet includes information relating to a basis weight of the sheet.

7. The image forming apparatus according to claim 1, wherein, in a case where the rotational speed of the second transfer member is changed from a first speed to a second speed while the conveyance speed of the first transfer member is maintained at the predetermined conveyance speed, the controller controls whether or not to control the image forming unit to form the measurement image based on the first speed and the second speed.

8. The image forming apparatus according to claim 7, wherein the controller controls the image forming unit to form the measurement image in a case where a speed difference between the first speed and the second speed is larger than a threshold.

9. The image forming apparatus according to claim 8, wherein, in a case where the speed difference between the first speed and the second speed is larger than the threshold, the controller controls the image forming unit to form the measurement image after the speed controller controls the rotational speed to the second speed.

10. The image forming apparatus according to claim 7, wherein the first speed is higher than the second speed.

11. The image forming apparatus according to claim 1, further including an image processing unit configured to perform image processing to image data based on another adjustment condition, wherein the image forming unit forms the image based on the image data after the image processing.

12. The image forming apparatus according to claim 11, further including a generation unit configured to generate the another adjustment condition based on the information relating to the sheet.

13. The image forming apparatus according to claim 1, wherein:

the image forming unit includes a photosensitive member, a laser scanner configured to expose the photosensitive member to form an electrostatic latent image on the photosensitive member, and a developing unit configured to develop the electrostatic latent image on the photosensitive member; and the laser scanner includes a light source configured to emit a laser light, a rotary polygon mirror configured to deflect the laser light, and a motor configured to rotate the rotary polygon mirror, wherein the motor adjusts a rotational speed of the rotary polygon mirror based on the adjustment condition.

14. The image forming apparatus according to claim 13, in a case where the controller controls the image forming unit to form the measurement image, the motor previously changes a target rotational speed of the rotary polygon mirror.

15. An image forming apparatus, comprising:

a plurality of image forming units configured to form images, each having a different color;

a transfer member, onto which the images formed by the plurality of image forming units are transferred, configured to convey the images;

a rotational member configured to rotate, and transfer the images onto a sheet passing through a transfer portion, wherein the transfer portion is between the transfer member and the rotational member, and wherein a surface speed of the rotational member is different from a surface speed of the transfer member;

a detection unit configured to detect color patterns formed on the transfer member, the color patterns being used for detecting color misregistration; and a controller configured to control the surface speed of the rotational member based on a sheet type of the sheet, wherein the controller is further configured to:

control, in a case where the sheet is of a first sheet type, the surface speed of the rotational member to be a first surface speed; and control, in a case where the sheet is of a second sheet type, the surface speed of the rotational member to be a second surface speed which is different from the first surface speed, and control a relative position of an image having a reference color among images which are to be formed by the plurality of image forming units and an image having another color among images which are to be formed by the plurality of image forming units, based on the detected color misregistration, wherein, in a case where first images are transferred to a first sheet which is of the first sheet type and thereafter second images are transferred to a second sheet which follows the first sheet and which is of the second type, the controller, during a predetermined period, changes the surface speed of the rotational member from the first surface speed to the second surface speed and controls the plurality of image forming units to form color patterns, the predetermined period being a period after transferring the first images to the first sheet which is of the first type and before forming the second images by the plurality of image forming units.

16. The image forming apparatus according to claim 15, wherein the surface speed of the transfer member is higher than the surface speed of the rotational member.

17. The image forming apparatus according to claim 15, wherein the plurality of color patterns are formed, in a case where a difference between the first surface speed and the second surface speed is larger than a threshold.

18. The image forming apparatus according to claim 15, wherein the rotational member includes a belt.

19. The image forming apparatus according to claim 15, wherein the type of the sheet includes information relating to a basis weight of the sheet.

20. The image forming apparatus according to claim 15, wherein the controller controls the detection unit to detect the color misregistration based on a relative position of a color pattern having a reference color among the plurality of color patterns and a color pattern having another color among the plurality of color patterns.

* * * * *